US008499472B2

(12) United States Patent
Bari et al.

(10) Patent No.: US 8,499,472 B2
(45) Date of Patent: Aug. 6, 2013

(54) HOUSEHOLD APPLIANCE FOR WASHING AND/OR DRYING CLOTHES

(75) Inventors: Elisabetta Bari, Portogruaro (IT); Nicola Reid, Pordenone (IT); Maurizio Ugel, Fiume Veneto (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 757 days.

(21) Appl. No.: 12/282,705

(22) PCT Filed: Mar. 6, 2007

(86) PCT No.: PCT/EP2007/001901
§ 371 (c)(1),
(2), (4) Date: Sep. 12, 2008

(87) PCT Pub. No.: WO2007/107237
PCT Pub. Date: Sep. 27, 2007

(65) Prior Publication Data

US 2009/0119945 A1 May 14, 2009

(30) Foreign Application Priority Data

Mar. 17, 2006 (EP) ..... 06111357

(51) Int. Cl.

| | |
|---|---|
| ***F26B 13/10*** | (2006.01) |
| ***F26B 7/00*** | (2006.01) |
| ***F26B 21/06*** | (2006.01) |
| ***F26B 3/32*** | (2006.01) |
| ***H05B 1/00*** | (2006.01) |
| ***H05B 3/02*** | (2006.01) |
| ***H05B 3/06*** | (2006.01) |

(52) U.S. Cl.
USPC ..... 34/528; 34/418; 34/258; 34/519; 219/211; 219/476; 219/525

(58) Field of Classification Search
USPC ..... 34/236, 528, 446, 483, 491, 260, 34/258, 420, 418, 572, 72, 237, 519; 219/211, 219/544, 528, 476, 520, 535, 525, 543, 553, 219/89, 237, 549
See application file for complete search history.

(56) References Cited

U.S. PATENT DOCUMENTS 5,023,433 A 6/1991 Gordon et al.
5,220,813 A * 6/1993 Chen et al. ..... 68/3 SS
(Continued)

FOREIGN PATENT DOCUMENTS

EP 1431442 A 6/2004
EP 1431442 A1 * 6/2004
FR 1140786 A 8/1957
FR 2613735 A * 10/1988

OTHER PUBLICATIONS

International Search Report for PCT/EP2007/001901, dated May 30, 2007, 2 pages.

*Primary Examiner* — Kenneth Rinehart
*Assistant Examiner* — John McCormack
(74) *Attorney, Agent, or Firm* — Pearne & Gordon LLP

(57) ABSTRACT

Household appliance for washing and/or drying clothes comprising an outer casing (2) provided with a worktop (3), and heating means (7) for drying garments laid upon the worktop (3), wherein the worktop (3) or the heating means (7) comprise sensor means (8) adapted to detect the moisture content of said garments, control means being provided for operating said heating means (7) in response to the moisture content being detected by said sensor means (8).

15 Claims, 5 Drawing Sheets

U.S. PATENT DOCUMENTS 6,784,673 B2 * 8/2004 Tomasi et al. ..... 324/664
7,451,657 B2 * 11/2008 Goldfine et al. ..... 73/760
2004/0035853 A1 * 2/2004 Pais ..... 219/548
2007/0068036 A1 * 3/2007 Choi ..... 34/528
2007/0182553 A1 * 8/2007 Kamizono et al. ..... 340/561
2008/0238433 A1 * 10/2008 Joutsenoja et al. ..... 324/457

* cited by examiner

HOUSEHOLD APPLIANCE FOR WASHING AND/OR DRYING CLOTHES

The present invention refers to a household appliance for washing and/or drying clothes.

European Patent application No. 05102644.1 discloses a household appliance for washing and/or drying clothes, which comprises an outer casing provided with a worktop and heating means to dry garments arranged on the same worktop.

Such arrangement allows garments made of delicate textile materials, such as cashmere, which are not adapted to undergo regular drying in a tumble dryer owing to the mechanical stresses, mainly in the form of impacts, which the textile fibres would be subject to there, to be dried in an adequately gentle manner, while at the same time doing away with the need for known time-consuming processes, such as line-drying or flat-drying, to be necessarily used to this purpose.

The time needed for a garment to be completely dried is determined by the kind of material which the garment is made of, along with the shape of the same garment and the initial moisture content thereof. Since these parameters usually vary to a great extent from garment to garment, it is quite difficult, actually, for pre-determined temporal drying cycles to be set up and designed in advance to effectively take all these parameters into due account so as to each time ensure a proper drying of each single garment.

There are circumstances, actually, in which this fact practically involves the possibility for the garments being handled—or at least some of them—to reach the desired drying degree well in advance of the end of the drying cycle having been selected by the user. In this case, they would therefore be subject to excessive heating that is likely to seriously affect the textile fibres and even damage them to the point that the garment is no longer fit for use.

A situation as the one cited above further implies an excessive energy usage, since—as anyone is certainly able to appreciate—the heating means would in this case keep being energized for a longer period of time than strictly needed to enable the garments to be fully dried or the selected drying degree to be reached.

The need therefore arises for the user—although properly selecting a given temporal drying cycle for the clothes to be handled—to continuously monitor and check the garments for the actual drying state thereof, in order to prevent them from undergoing excessive, unnecessary heating or—the other way round—to possibly repeat the drying cycle in the case that the garments are not adequately dry at the end of the just concluded one.

It is therefore an object of the present invention to provide an improved household appliance of the above-cited kind, which is effective in doing away with all above-noted drawbacks of prior-art appliances of the same kind.

Within such general object, it is a purpose of the present invention to provide a household appliance of the above-cited kind that enables all risks to be safely averted, which are generally connected with a garment being dried undergoing excessive heating.

Another purpose of the present invention is to provide a household appliance of the above-cited kind that enables garments to be effectively dried without the user being required to directly check the same garments for the actual drying state thereof.

According to the present invention, these aims, along with further ones that will become apparent from the following disclosure, are reached in an arrangement incorporating the features as defined and recited in the claims 1 to 12 appended hereto.

Features and advantages of the present invention will anyway be more readily understood from the description that is given below way of non-limiting example with reference to the accompanying drawings, in which.

Figure 1:
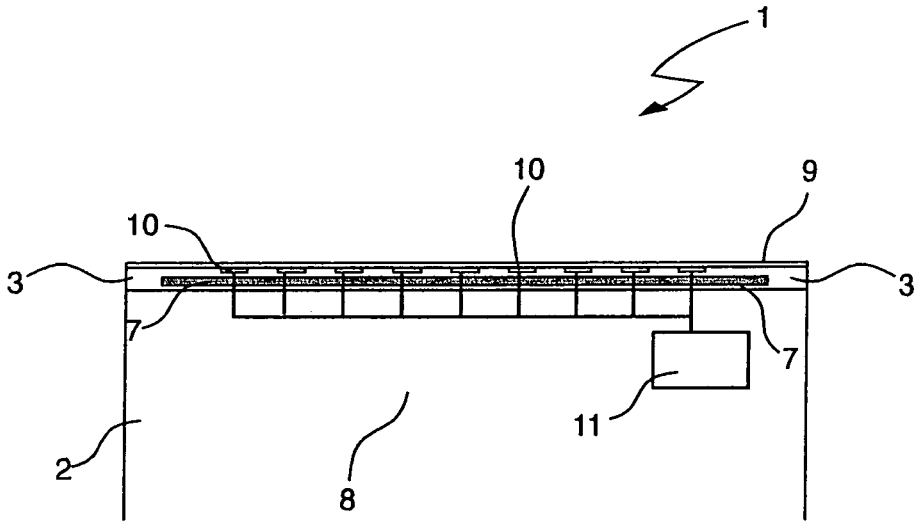
FIG. 1 is a cross-sectional side elevational view of the household appliance according to the present invention.

The household appliance for washing and/or drying clothes according to the present invention—as generally indicated with the reference numeral 1 in the Figures—comprises an outer casing 2 with a worktop 3 and a front panel 4 carrying operational input controls 5, a drum rotatably supported inside the outer casing 2 and adapted to be loaded with the items to be washed and/or dried, an opening for loading and unloading the items into and from the drum, and a door 6 for closing the opening.

The household appliance comprises heating means 7, which are associated to the worktop, and are adapted to dry clothes that are laid upon the worktop 3.

The worktop 3 or the heating means 7 themselves comprise sensor means 8 for detecting the moisture content of the garments. Further control means are provided to operate said heating means 7 in response to the moisture content detected by said sensor means 8.

The heating means 7 comprise at least a heating layer, such as an electric heating element or resistor, which is integrated in the worktop 3, so that the latter is converted into a drying surface 9 adapted to support garments that are laid thereupon in a flat condition.

The sensor means 8 comprise a conductimetric sensor, which is provided close by the drying surface 9 of the worktop 3, so as to be adapted to detect the electric conductivity value as measured between a plurality of adjacent conductive sections forming the drying surface 9 and determined by the moisture content of the garment being laid to dry upon the drying surface 9.

Basically, the moisture content of the garment being dried determines the conductivity value being measured between the different conductive sections of the drying surface 9, so that a decrease in the moisture content of the garment during the drying process will bring about a corresponding decrease in the value of electric conductivity existing between the conductive sections of the drying surface 9.

The conductimetric sensor may for instance be comprised of a plurality of electrically connected conductive elements that are so arranged on the drying surface 9 of the worktop 3 as to come into contact with the garment that is laid upon the drying surface 9.

Via an appropriate electric circuit, the conductimetric sensor is adapted to continuously detect and monitor the variations in electrical conductivity taking place between the various conductive elements following the gradual removal of moisture from the garment being dried, i.e. the gradual decrease in the moisture content thereof during the drying process.

The different values of electric conductivity measured between the conductive sections of the drying surface 9 can therefore be brought into mutual relation with corresponding drying degrees reached each time by the garment being handled.

The control means are adapted to compare the electric conductivity values measured between the conductive sections of the drying surface with pre-determined threshold values, which will have been preliminarily derived experimentally to represent different final drying degrees of the garment. These final drying degrees are selectable by the user by setting corresponding drying cycles via the control panel of the household appliance. At the beginning of each cycle, the control means are in fact able to retrieve from a storage memory the threshold conductivity values corresponding to the drying cycle being so selected by the user.

Furthermore, the control means are adapted to de-energize the heating means 7 as soon as the conductivity values measured between the various conductive sections of the drying surface reach the threshold values corresponding to the selected cycle.

The end-of-cycle condition, i.e. the condition in which the desired drying degree is reached and the drying cycle has to be terminated, is therefore determined automatically by the control means based on the conductivity values detected by the conductimetric sensor and the threshold values relating to the selected cycle.

The risk of the garment being dried to undergo overheating is therefore fully done away with, while the user is no longer forced to continuously check the garments for the actual drying state thereof.

In a second embodiment of the present invention, the sensor means 8 comprise a capacitive sensor, which is provided in an arrangement in or on the worktop and is adapted to sense and measure the capacitive loading generated by the moisture content in the garment laid upon the worktop to dry.

Owing to the electric conductivity of water, a moisture-laden garment, i.e. a garment that is soaked with washing water to some extent, will in fact produce a greater capacitive loading than the one generated by the same garment in a dry state, i.e. a garment whose electric conductivity is practically due to the sole dielectric material which it is made of. The variation in the capacitive loading that is brought about by the gradual removal of moisture from the garment as the latter goes through drying, can of course be correlated with the degree of drying reached by the garment itself.

The capacitive sensor comprises a plurality of electrodes 10 provided on the worktop 3 along the contact surface between the garment to be dried and the same worktop, i.e.—therefore—along the drying surface 9 defined by the worktop 3.

These electrodes are connected to circuit means 11, which may for instance be comprised of an oscillatory circuit or a voltage divider, although—as those skilled in the art will readily be capable of appreciating—use can be made in this connection of other types of circuits that are generally known as such in the art. Anyway, the circuit means 11 are adapted to detect and measure the capacitance value on each single electrode 10 or, in a different arrangement, the circuit means 11 are so arranged as to be able to activate a single electrode 10 at a time, while grounding the remaining ones that may be either connected to a reference potential or not connected at all; in this way, they eventually activate all electrodes in a sequence. Then, the same circuit means measure the capacitance value between the measurement electrode being activated each time and the other electrodes that are on the contrary grounded, thereby obtaining a capacitance value for each one of the electrodes 10.

Preferably, these electrodes 10 are covered with a thin isolating layer adapted to prevent the electrodes 10 from being able to come into direct contact with moisture, as this would of course affect the accuracy of the capacitance measurements made on the same electrodes. In an alternative embodiment, the electrodes 10 themselves are integrated or embedded within the thickness of the worktop 3, so as to turn out as being positioned in proximity of the surface of the worktop, which is provided to support a garment to be laid thereupon for drying. Such arrangement is effective in ensuring that the electrodes 10 are safely isolated, while at the same time keeping the detection sensitivity on the same electrodes 10 at an adequately high level.

The capacitive sensor is adapted to detect on each single electrode the capacitance vale that is brought about by the close capacitive coupling of each single electrode with the water content of the garment, wherein high capacitance values are indicative of a high water content in the garment.

The gradual removal of water from the garment, i.e. the gradual decrease in the moisture content thereof as the drying process goes on, causes the capacitance values being measured on the electrodes 10 to decrease correspondingly.

Again, the control means are adapted to compare the capacitance values measured on the electrodes 10 with predetermined threshold values, which will have been preliminarily derived experimentally to represent different final drying degrees of the garment. These final drying degrees are selectable by the user by setting corresponding drying cycles via the control panel of the household appliance. At the beginning of each cycle, the control means are in fact able to retrieve from a storage memory the threshold capacitance values corresponding to the drying cycle being so selected by the user.

The control means are adapted to de-energize the heating means 7 as soon as the capacitance values measured on the electrodes eventually reach or decrease below the threshold values corresponding to the selected cycle.

In this particular case, for example, the control means can switch off the heating means 7 based on either how many of or which ones among the electrodes 10 deliver a capacitance value that compares with the corresponding threshold value.

In a further embodiment of the present invention, the sensor means 8 are comprised of an electric field sensor, which is generally known in the art as electric field imaging device and is adapted to detect the electric field loading caused by the variation in the conductive moisture content of the garment placed within the electric field generated by the sensor.

The electric field sensor is comprised of a plurality of electrodes distributed on the worktop, as well as circuit means as needed to apply an AC signal to a first electrode and measure both the current output from that electrode and the current input in a set of other electrodes connected to the AC-coupled electrode. The garment intercepts part of the electric field extending from the AC-coupled sending electrode to the other receiving electrodes in a manner that is proportional to the amount of water still contained in the garment.

The circuit means are adapted to activate a single electrode at a time by applying the AC signal thereto, while the other electrodes act as receiving electrodes; in this way, the circuit means eventually activate all electrodes in a sequence.

In a similar manner as described hereinbefore in connection with the capacitive sensor, the control means are capable of switching off the heating means 7 when the current values measured on the electrodes are detected to have reached or moved beyond threshold values corresponding to the selected drying cycle, wherein these threshold values will again have been determined experimentally as being representative of different final drying degrees of the garments.

In a still further embodiment of the present invention, the heating means 7 are contemplated to comprise a plurality of electric heating elements, or resistors, that are operable independently of each other in response to the moisture content being detected by the sensor means 8 to exist during the drying cycle in the different zones or regions of the garment, where the heating elements are arranged.

During the drying cycle it may in fact occur that some portions of the garment dry up quicker than other portions thereof. The sensor means 8, and in particular the capacitive sensor and the electric field sensor, are capable—via the electrodes—of identifying the areas of the worktop where a lower moisture content is detected than the one found to exist in other areas. The control means 8 are therefore able to de-energize or, as the case may be, reduce the power supply to the heating elements that lie in correspondence to the electrodes detecting a low moisture content. This practically enables the garment to be dried in an extremely even manner, as well as the use and the operation of the heating elements 7 to be at the same time made as rational as possible, thereby further reducing energy usage.

Advantageously, said heating means 7 are provided in the form of a heating mat comprising one or more electric heating elements or resistors 12 embedded in an isolating envelope or package capable of ensuring an even heat distribution and a low surface temperature. The heating mat preferably includes a flexible electric heating element disposed in an envelope of an elastomeric material such as silicone rubber, neoprene or polyamide, wherein it will however be appreciated that other types of polymeric materials or even natural rubber may of course be used to this purpose.

In this connection, even the use of conductive polymers can be advantageously envisaged to make the heating mat.

The household appliance incorporates said heating mat in view of enabling garments laid upon its worktop 3 to undergo drying.

Figure 2:
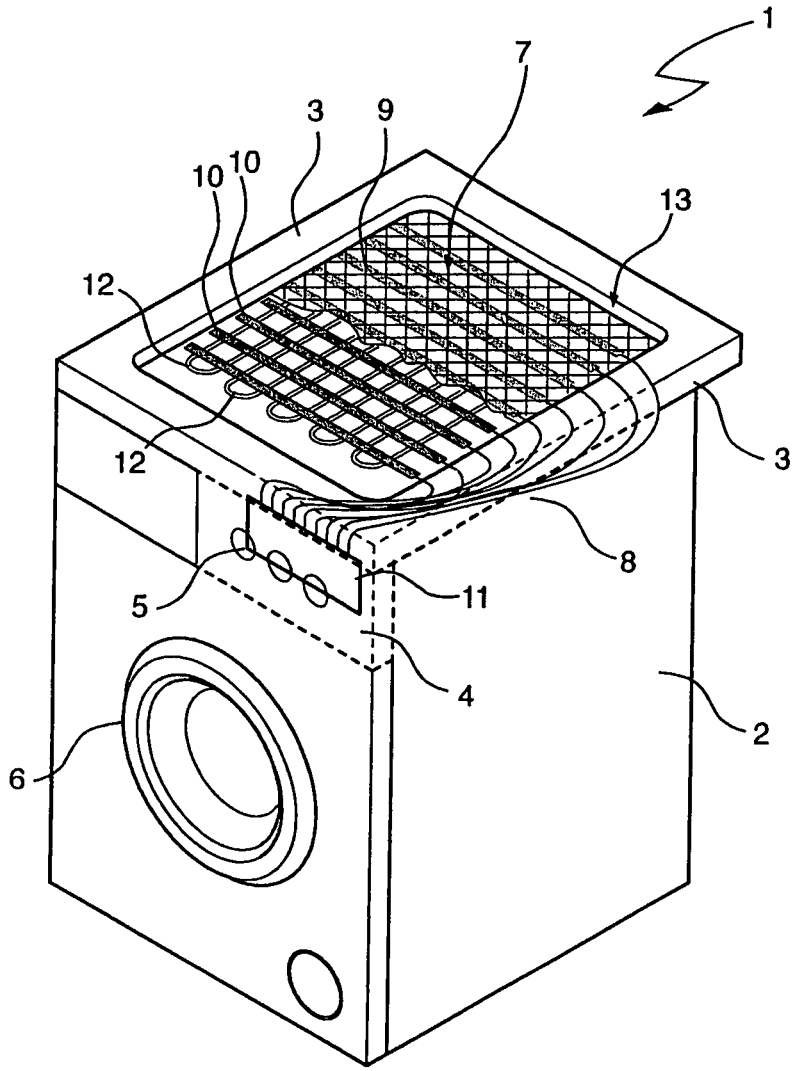
FIG. 2 is a perspective view of the household appliance according to the present invention.

The worktop 3 can include the heating mat integrally, so as this is illustrated in FIG. 2, wherein a central recess or seat 9 is in this case provided in the worktop 3 to accommodate and support the heating mat in an operative position thereof, in which the heating mat preferably lies flush with a peripheral portion of the same worktop.

Figure 4:
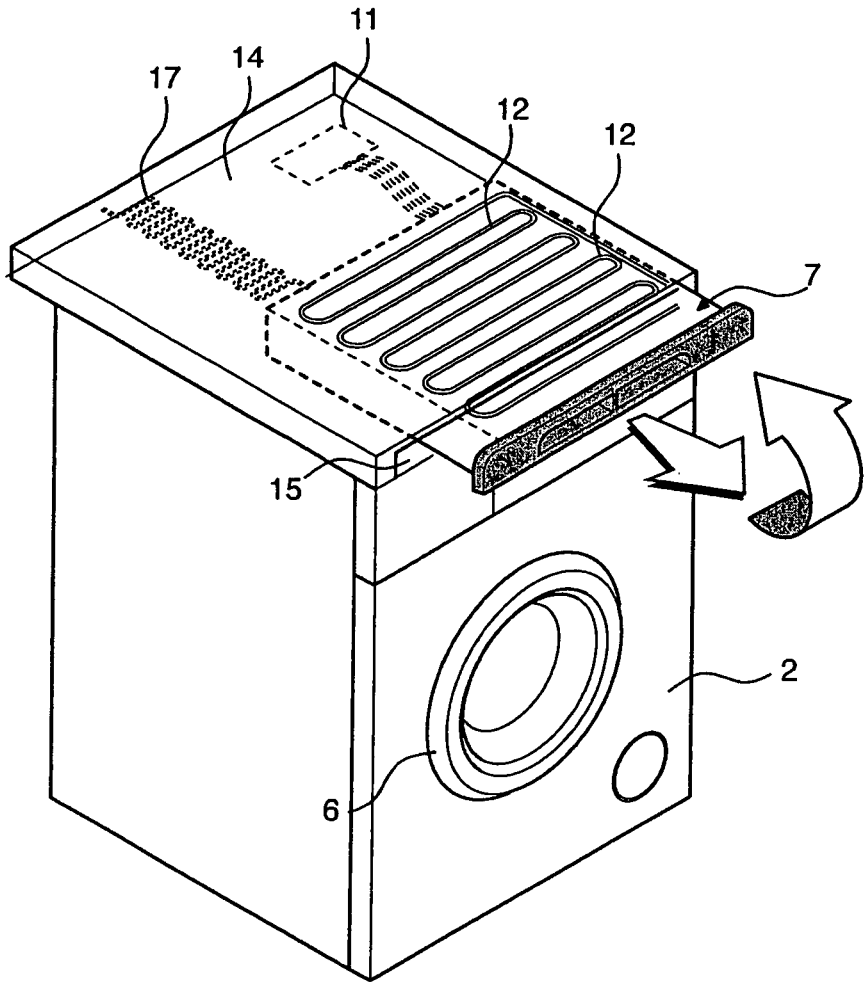
FIG. 4 is a perspective view of the household appliance according to a further embodiment of the present invention.
Figure 5:
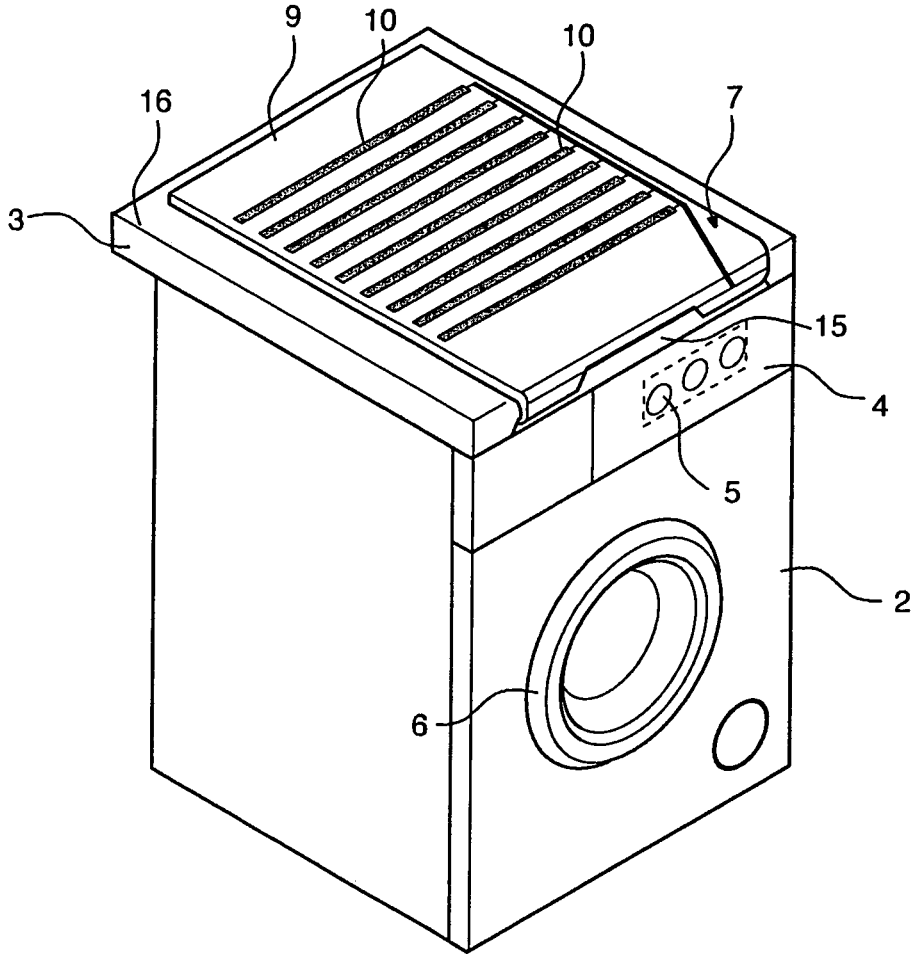
FIG. 5 is a perspective view of the household appliance shown in FIG. 4, with the heating mat in an extended condition, in which it is pulled out of the worktop.

The worktop 3 may define a kind of casing 14, so as shown in FIGS. 4 and 5, adapted to contain the heating mat when the latter is not in use, this casing being provided with an aperture 15, through which the heating mat is accessible by a user. The heating mat itself is slidably associated to the worktop 3 so as to be able to be pulled out of the casing 14 and slidably laid upon a top portion 16 of the worktop 3. Expediently, the heating mat comprises sliding hinges adapted to engage guide means provided in the casing 14 of the worktop 3, so that the heating mat can be pulled out of the casing 14 and rotated to be duly positioned on the top portion 16 of the worktop 3. The heating elements 12 of the heating mat can be connected to an extensible power-supply cable 17 provided in the casing 14, or the sliding means themselves can be provided integrally with power-supply terminals adapted to energize the heating mat.

Figure 3:
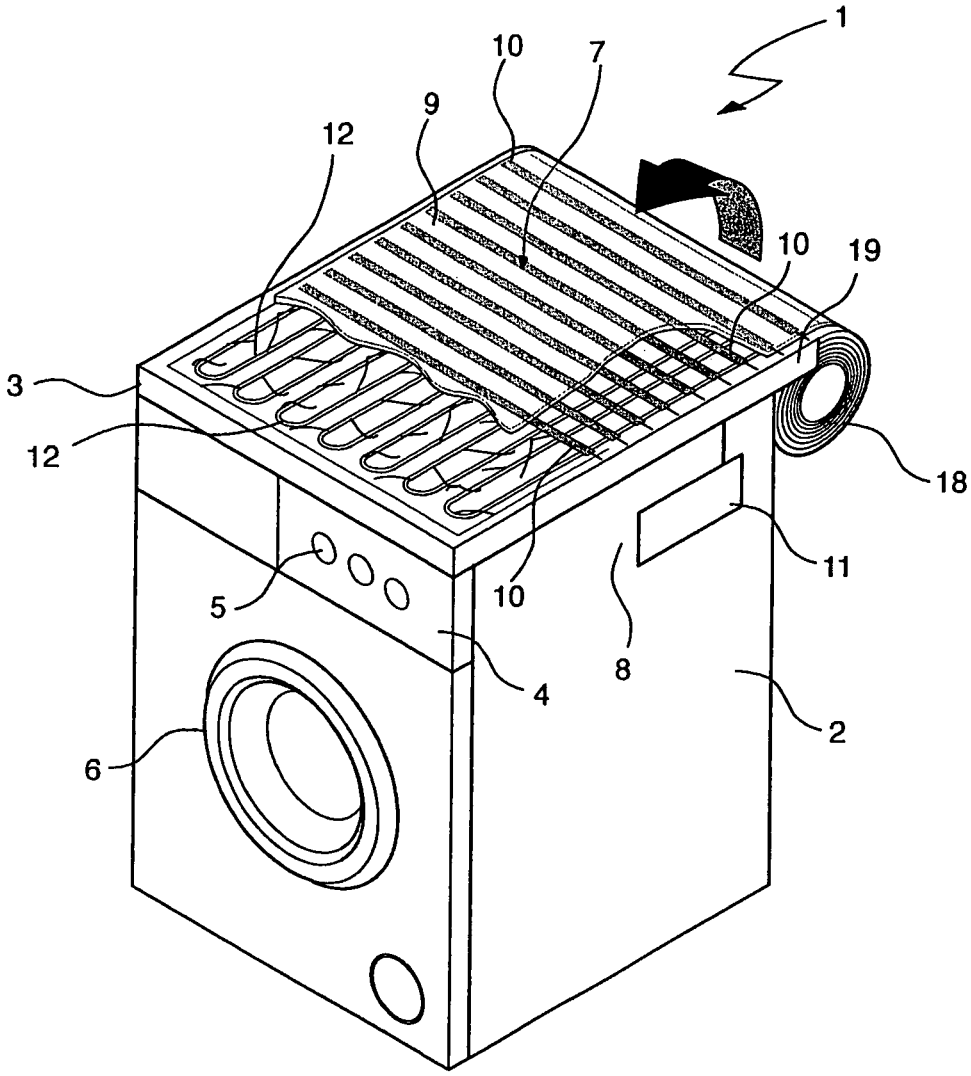
FIG. 3 is a perspective view of the household appliance according to another embodiment of the present invention.

On the other hand, the heating mat can be mechanically associated to the household appliance by means of a coiling device 18 associated to the worktop 3, as this is best shown in FIG. 3. The coiling device 18 may be formed integrally on an outer edge 19 of the worktop 3 and the heating mat is removably associated to this coiling device 18 so as to be adapted to slide—thanks to the resilient properties thereof—between a first position, in which the heating mat is wound around the coiling device 18, and a second position, in which the heating mat lies flat on the worktop 3.

The above-cited sensor means 8 for detecting the moisture content of the garment to be dried are in this case no longer provided in/on the worktop, but rather in/on the heating mat itself.

In a first embodiment the use is contemplated of a conductimetric sensor adapted to detect the electric conductivity value as measured between a plurality of adjacent conductive sections forming the drying surface of the heating mat designed to be in contact with and support the garment to be dried.

This conductimetric sensor, as well as its mode of operation in connection with the automatic determination of the end-of-cycle condition to automatically stop the drying process, are fully similar to what has been described hereinbefore in the case of the conductimetric sensor of the worktop.

Thus, the conductimetric sensor may comprise a plurality of electrically connected conductive elements arranged on the drying surface 9 of the heating mat, so as to come in contact with the garment to be dried.

Via appropriate circuit means, the conductimetric sensor is adapted to continuously detect and monitor the decrease in the electric conductivity value between the various conductive elements that is brought about by moisture being gradually removed from the garment, i.e. the moisture content in the garment decreasing gradually during the drying process.

In a further embodiment of the present invention, the eating mat comprises sensor means 8 in the form of a capacitive sensor that is adapted to detect and measure the capacitive loading generated by the moisture content in the garment being laid upon the heating mat for drying.

This capacitive sensor, as well as its mode of operation in connection with the automatic determination of the end-of-cycle condition to automatically stop the drying process, are fully similar to what has been described hereinbefore in the case of the capacitive sensor applied to the worktop.

Anyway, this capacitive sensor comprises circuit means 11 connected to a plurality of electrodes 10 provided inside the isolating envelope or package of the mat and situated in proximity of the drying surface of the heating mat that is designed to be in contact with and support the garment to be dried, so as to ensure a close capacitive coupling between each single electrode 10 and the moisture contained in the garment.

In a still further embodiment of the present invention, the heating mat comprises sensor means 8 in the form of an electric field sensor, which is adapted to detect the electric field loading as caused by the variation in the conductive moisture content of the garment placed within the electric field generated by the sensor.

This electric field sensor, as well as its mode of operation in connection with the automatic determination of the end-of-cycle condition to automatically stop the drying process, are fully similar to what has been described hereinbefore in the case of the electric field sensor applied to the worktop.

Anyway, the electric field sensor comprises circuit means connected to a plurality of electrodes provided inside the isolating envelope or package of the mat. Such circuit means are adapted to apply an AC signal to a first electrode and measure both the current output from that electrode and the current input in a set of other electrodes connected to the AC-coupled electrode. The garment intercepts part of the electric field extending from the AC-coupled sending electrode to the other receiving electrodes in a manner that is proportional to the amount of water still contained in the garment.

In another embodiment of the present invention, the heating mat is contemplated to comprise a plurality of electric heating elements, or resistors, that are operable independently of each other in response to the moisture content being detected by the sensor means 8 to exist during the drying cycle in the different zones or regions of the garment, where the heating elements are arranged.

During the drying cycle it may in fact occur that some portions of the garment dry up quicker than other portions thereof. The sensor means, and in particular the capacitive sensor and the electric field sensor, are capable—via the electrodes—of identifying the areas of the worktop where a lower moisture content is detected than the one found to exist in other areas. The control means are therefore able to de-energize or, as the case may be, reduce the power supply to the heating elements that lie in correspondence to the electrodes detecting a low moisture content. This practically enables the garment to be dried in an extremely even manner, as well as the use and the operation of the heating elements to be at the same time made as rational as possible, thereby further reducing energy usage.

The household appliance according to the present invention enables the heating means to be automatically switched off, i.e. de-energized, as soon as the garment to be dried laid upon the worktop reaches a given drying degree as selected each time by the user, thereby doing therefore completely away with the risk for the garment itself to be exposed to overheating. At the same time, the energy usage profile of the heating means is considerably improved, since these means are only energized for the time that is strictly necessary for the selected degree of drying to be reached.

A further advantage of the household appliance according to the present invention derives from the fact that the user has no longer to check the garment being dried for the drying state in view of making sure that it is being dried in a proper manner and is not going to be exposed to unnecessary overheating.

The inventive heating and drying means as described above can of course be applied also to a washing and/or drying appliance of the top-loading type.

The invention claimed is:

1. Household appliance for washing and/or drying clothes comprising:

an outer casing (2) enclosing a drum adapted to be loaded with items to be washed and/or dried within said drum through a first treatment process, the outer casing (2) being provided with:

a worktop (3) extending substantially horizontally over the drum, and heating means (7) for drying garments laid upon the worktop (3) through a second treatment process, said heating means (7) forming a heating layer mechanically connected to the household appliance;

wherein said worktop (3) or said heating (7) means comprises:

sensor means (8) adapted to detect a moisture content of said garments, said sensor means (8) being arranged so as to be covered by the garments laid upon the worktop (3) during a drying operation, wherein said sensor means (8) comprise a conductimetric sensor adapted to detect the electric conductivity value being measured between a plurality of adjacent conductive sections provided on the worktop (3) or the heating mat, as determined by the moisture content of the garment being laid upon the worktop (3) or the heating mat to dry, and control means being provided for operating said heating means (7) in said second treatment process in response to the moisture content being detected by said sensor means (8), said second treatment process being operable by the control means independently from the first treatment process.

2. Household appliance according to claim 1, wherein said heating means (7) are provided in the form of a heating mat comprising one or more electric heating elements (12) embedded in an isolating envelope.

3. Household appliance according to claim 1, wherein said control means are adapted to de-energize the heating means (7) when the electric conductivity values being measured between the various adjacent conductive sections reach down to or decrease below pre-determined threshold values representing different final drying degrees of the garment.

4. Household appliance according to claim 3, wherein said conductimetric sensor comprises a plurality of electrically connected conductive elements arranged on the worktop (3) or the heating mat so as to come into contact with the garment to be dried, said conductimetric sensor being adapted to continuously detect and monitor via circuit means the variations in the electric conductivity value between the various conductive elements being brought about by moisture being gradually removed from the garment as the drying process proceeds towards completion.

5. Household appliance for washing and/or drying clothes comprising:

an outer casing (2) enclosing a drum adapted to be loaded with items to be washed and/or dried within said drum through a first treatment process, the outer casing (2) being provided with:

a worktop (3) extending substantially horizontally over the drum, and heating means (7) for drying garments laid upon the worktop (3) through a second treatment process, said heating means (7) forming a heating layer mechanically connected to the household appliance;

wherein said worktop (3) or said heating (7) means comprises:

sensor means (8) adapted to detect a moisture content of said garments, said sensor means (8) being arranged so as to be covered by the garments laid upon the worktop (3) during a drying operation, wherein said sensor means (8) comprise a capacitive sensor adapted to detect and, measure the capacitive loading that is brought about by the moisture content in the garment laid upon the worktop or the heating mat for drying, said capacitive sensor comprising a plurality of electrodes (10) covered by an isolating layer, and control means being provided for operating said heating means (7) in said second treatment process in response to the moisture content being detected by said sensor means (8), said second treatment process being operable by the control means independently from the first treatment process.

6. Household appliance according to claim 5, wherein said plurality of electrodes (10) is associated to the worktop (3) or to the isolating envelope of the heating mat, and connected to circuit means (11) so as to be able to detect the capacitance value on each such electrode as determined by the close capacitive coupling between each single electrode and the moisture contained in the garment laid upon the worktop or the heating mat for drying.

7. Household appliance according to claim 6, wherein said control means are adapted to de-energize the heating means (7) when the capacitance values measured on the electrodes (10) are sensed to have reached down to or below pre-determined threshold values representing different final drying degrees of the garment.

8. Household appliance for washing and/or drying clothes comprising:

an outer casing (2) enclosing a drum adapted to be loaded with items to be washed and/or dried within said drum through a first treatment process, the outer casing (2) being provided with:

a worktop (3) extending substantially horizontally over the drum, and heating means (7) for drying garments laid upon the worktop (3) through a second treatment process, said heating means (7) forming a heating layer mechanically connected to the household appliance;

wherein said worktop (3) or said heating (7) means comprises:

sensor means (8) adapted to detect a moisture content of said garments, said sensor means (8) being arranged so as to be covered by the garments laid upon the worktop (3) during a drying operation, wherein said sensor means (8) comprise an electric field sensor adapted to detect the electric field loading caused by the variation in the conductive moisture content of the garment placed within the electric field generated by the sensor, and wherein the electric field loading being detected through a current signal whose measured values are used by said control means to de-energize the heating means (7) when said measured values have reached down to or below predetermined threshold values representing different final drying degrees of the garment, and control means being provided for operating said heating means (7) in said second treatment process in response to the moisture content being detected by said sensor means (8), said second treatment process being operable by the control means independently from the first treatment process.

9. Household appliance for washing and/or drying clothes comprising an outer casing (2) provided with a worktop (3), and heating means (7) for drying garments laid upon the worktop (3), wherein said worktop (3) or said heating (7) means comprise sensor means (8) adapted to detect the moisture content of said garments, control means being provided for operating said heating means (7) in response to the moisture content being detected by said sensor means (8), wherein said sensor means (8) comprise an electric field sensor adapted to detect the electric field loading caused by the variation in the conductive moisture content of the garment placed within the electric field generated by the sensor, wherein said electric field sensor comprises a plurality of electrodes associated to the worktop or to the isolating envelope of the heating mat, as well as circuit means adapted' to apply an AC signal to a first electrode and measure both the current output from the first electrode and the current input in a set of other receiving electrodes connected to the AC-coupled first electrode, said garment intercepting part of the electric field extending from the AC-coupled first electrode to the other receiving electrodes in a manner that is proportional to the amount of water still contained in the garment, and wherein said control means are adapted to de-energize the heating means (7) when the current values measured on the electrodes are sensed to have reached down to or below predetermined threshold values representing different final drying degrees of the garment.

10. Household appliance for washing and/or drying clothes comprising:

an outer casing (2) enclosing a drum adapted to be loaded with items to be washed and/or dried within said drum through a first treatment process, the outer casing (2) being provided with:

a worktop (3) extending substantially horizontally over the drum, and heating means (7) for drying garments laid upon the worktop (3) through a second treatment process, said heating means (7) forming a heating layer mechanically connected to the household appliance;

wherein said worktop (3) or said heating (7) means comprises:

sensor means (8) adapted to detect a moisture content of said garments, said sensor means (8) being arranged so as to be covered by the garments laid upon the worktop (3) during a drying operation, and control means being provided for operating said heating means (7) in said second treatment process in response to the moisture content being detected by said sensor means (8), said second treatment process being operable by the control means independently from the first treatment process wherein said heating means (7) or said heating mat comprise a plurality of electric heating elements, or resistors, that are operable independently of each other in response to the moisture content being detected by the sensor means (8) to exist during the drying cycle in the different zones or regions of the garment, where the heating elements are arranged.

11. A household appliance for washing and/or drying clothes comprising:

an outer casing enclosing a drum adapted to be loaded with items to be washed and/or dried, the outer casing being provided with:

a worktop extending substantially horizontally over the drum, and heating means for drying garments laid upon the worktop, said heating means forming a heating layer mechanically connected to the household appliance;

wherein said worktop or said heating means comprises:

sensor means adapted to detect a moisture content of said garments, said sensor means being arranged so as to be covered by the garments laid upon the worktop during a drying operation, wherein said sensor means further comprises:

a plurality of electrodes, associated with the worktop or the heating means, adapted measure an electric field loading caused by a variation in the moisture content of said garments; and a circuit means adapted to apply an AC signal to a first electrode of the plurality of electrodes, to measure the AC signal output by the first electrode and to measure current received by a set of other receiving electrodes of the plurality of electrodes, wherein a garment intercepts part of the AC signal; and control means being provided for operating said heating means in response to the moisture content being detected by said sensor means.

12. The household appliance according to claim 11, wherein said control means are adapted to de-energize the heating means when sensor means detects the current output of the first electrode and the current received by the set of other receiving electrodes that correspond to thresholds representing different final drying degrees of the garment.

13. The household appliance according to claim 1, wherein the household appliance is a washing machine and said first treatment process is a washing operation to wash said items within said drum.

14. Household appliance according to claim 5, wherein said heating means (7) are provided in the form of a heating mat comprising one or more electric heating elements (12) embedded in an isolating envelope.

15. Household appliance according to claim 8, wherein said heating means (7) are provided in the form of a heating mat comprising one or more electric heating elements (12) embedded in an isolating envelope.

* * * * *

UNITED STATES PATENT AND TRADEMARK OFFICE

CERTIFICATE OF CORRECTION

PATENT NO. : 8,499,472 B2
APPLICATION NO. : 12/282705
DATED : August 6, 2013
INVENTOR(S) : Bari et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 830 days.

Signed and Sealed this
Fifteenth Day of September, 2015

Michelle K. Lee

Michelle K. Lee
*Director of the United States Patent and Trademark Office*